US007140191B2

(12) United States Patent
Lee et al.

(10) Patent No.: US 7,140,191 B2
(45) Date of Patent: Nov. 28, 2006

(54) REFRIGERATOR AND TEMPERATURE SENSOR FIXING METHOD IN THE REFRIGERATOR

(75) Inventors: Tae Hee Lee, Seoul (KR); Kyung Sik Kim, Incheon-si (KR); Yang Gyu Kim, Seoul (KR); Se Young Kim, Seoul (KR); Chan Ho Chun, Seoul (KR); Youn Seok Lee, Kyungki-do (KR)

(73) Assignee: LG Electronics Inc., Seoul (KR)

( * ) Notice: Subject to any disclaimer, the term of this patent is extended or adjusted under 35 U.S.C. 154(b) by 353 days.

(21) Appl. No.: 10/746,338

(22) Filed: Dec. 29, 2003

(65) Prior Publication Data

US 2004/0182098 A1 Sep. 23, 2004

(30) Foreign Application Priority Data

Mar. 17, 2003 (KR) ..... 10-2003-0016577

(51) Int. Cl.
*F25B 1/00* (2006.01)
*F25B 49/00* (2006.01)
*F25D 25/00* (2006.01)

(52) U.S. Cl. ..... 62/227; 62/465

(58) Field of Classification Search ..... 62/227, 62/228.1, 440, 465
See application file for complete search history.

(56) References Cited

U.S. PATENT DOCUMENTS 6,089,146 A 7/2000 Nam et al.
6,125,641 A * 10/2000 Kim et al. ..... 62/187
6,550,261 B1 * 4/2003 Shima et al. ..... 62/176.1
6,625,998 B1 * 9/2003 Kim et al. ..... 62/186
6,755,243 B1 * 6/2004 Cho et al. ..... 165/289

FOREIGN PATENT DOCUMENTS

JP 3172386 B2 3/2001
KR 1999-0031528 A 5/1999
KR 2001-0065685 A 7/2001

* cited by examiner

*Primary Examiner*—Marc Norman
(74) *Attorney, Agent, or Firm*—Birch, Stewart, Kolasch & Birch, LLP

(57) ABSTRACT

A direct cooling type refrigerator capable of rapidly and accurately controlling the temperature thereof, reducing the ON/OFF time of its compressor, thereby preventing the temperature deviation of its storage compartment from increasing over a predetermined value. The refrigerator includes an outer casing defining an appearance of the refrigerator, an inner casing arranged within the outer casing, and defined with a storage compartment, an insulator interposed between the outer casing and the inner casing, a compressor for compressing a refrigerant, an evaporator arranged to be in contact with the inner casing, and adapted to cool the inner casing in accordance with evaporation of a refrigerant passing therethrough, a temperature sensor provided with a surface contact area closely contacting the inner casing, and adapted to sense a temperature of the inner casing, and a control unit for controlling the compressor in accordance with the temperature sensed by the temperature sensor.

16 Claims, 7 Drawing Sheets

REFRIGERATOR AND TEMPERATURE SENSOR FIXING METHOD IN THE REFRIGERATOR

This nonprovisional application claims priority under 35 U.S.C. § 119(*a*) on Patent Application No. 10-2003-0016577 filed in Korea on Mar. 17, 2003, which is herein incorporated by reference.

BACKGROUND OF THE INVENTION

1. Field of the Invention

The present invention relates to a direct cooling type refrigerator, and more particularly to a direct cooling type refrigerator in which the contact area between an inner casing defined with a storage compartment and a temperature sensor is large so that the temperature sensor can accurately and rapidly sense a variation in the temperature of the storage compartment, thereby reliably controlling a compressor. Also, the present invention relates to a temperature sensor fixing method in such a direct cooling type refrigerator.

2. Description of the Related Art

Generally, refrigerators may be classified, in terms of their cooling systems, into a direct cooling type refrigerator, in which its inner casing defined with a storage compartment to be used as a freezing compartment or refrigerating compartment is directly cooled by an evaporator, and an indirect cooling type refrigerator, in which cold air produced in accordance with a heat exchange operation of the evaporator is supplied to the storage compartment by a cooling fan.

As shown in FIG. 1, the direct cooling type refrigerator generally includes an outer casing 2 defining the appearance of the refrigerator, an inner casing 4 arranged within the outer casing 2, and defined with a storage compartment F, and an insulator 6 interposed between the outer casing 2 and the inner casing 4. The direct cooling type refrigerator also includes a compressor 8 for compressing a refrigerant, a condenser 10 for condensing a high-pressure refrigerant gas emerging from the compressor 8 into a liquid phase, a capillary tube 12 for reducing the pressure of the refrigerant emerging from the condenser 10, an evaporator 14 for performing heat exchange with the inner casing 4, thereby cooling the storage compartment F, a temperature sensor for measuring the temperature of the inner casing 4, and a control unit for turning on the compressor 8 when the temperature sensed by the temperature sensor is not less than a first predetermined temperature, for example, 5° C., while turning off the compressor 8 when the sensed temperature is not more than a second predetermined temperature, for example, −30° C.

The temperature sensor includes a heat transfer member 18 arranged to be linearly in contact with a desired portion of the inner casing 4, and a thermistor adapted to measure the temperature of the heat transfer member 18, and to output a temperature signal corresponding to the measured temperature to the control unit.

The heat transfer member 18 is attached to a desired outer surface portion of the inner casing 4 while being covered by an aluminum tape attached to the outer surface of the inner casing 4 such that it is linearly in contact with the outer surface portion of the inner casing 4.

Now, operation of the conventional direct cooling type refrigerator having the above mentioned configuration will be described.

When the condenser 10 receives a refrigerant, which has been compressed into a high-temperature and high-pressure vapor phase, it absorbs heat from the received refrigerant, and discharges the absorbed heat, thereby changing the refrigerant into a normal-temperature and high-pressure liquid phase. Subsequently, the refrigerant condensed by the condenser 10 in such a manner is subjected to a pressure reduction process while passing through the capillary tube 12, and then performs heat exchange with the inner casing 4 while passing through the evaporator 14, thereby cooling the inner casing 4. In accordance with such an operation, the interior of the storage compartment F is maintained at a low temperature by virtue of heat exchange performed between air present in the storage compartment F and the inner casing 4, and natural convection of the air in the storage compartment F.

Meanwhile, the heat from the inner casing 4 is transferred to the heat transfer member 16, so that the heat transfer member 16 is heated. The thermistor measures the temperature of the heat transfer member 16, and sends a signal representing the measured temperature to the control unit.

When the control unit determines, based on the signal received thereto, that the temperature of the inner casing 4 is not more than the second predetermined temperature, for example, −30° C., it outputs an OFF signal to the compressor so as to stop the operation of the compressor 8. On the other hand, when the control unit determines that the temperature of the inner casing 4 is not less than the first predetermined temperature, for example, 5° C., it outputs an ON signal to the compressor 8 so as to operate the compressor 8.

In the above mentioned conventional direct cooling type refrigerator, the time taken to transfer the heat from the inner casing 4 to the heat transfer member 16 of the temperature sensor is lengthened because the heat transfer member 16 is linearly in contact with the inner casing 4. For this reason, it is impossible to rapidly control the turning-on/off of the compressor 8 in response to a variation in the temperature of the storage compartment F. Furthermore, the heat transfer member 16 of the temperature sensor may not be in contact with the inner casing 4 at a certain portion thereof. In this case, there may be problems of a degradation in temperature sensing performance and dispersion of the sensed temperature.

Moreover, the heat transfer member 16 of the temperature sensor cannot be firmly fixed because it is fixed to the aluminum tape 19 which is, in turn, fixed to the inner casing 4. For this reason, the contact between the heat transfer member 16 and the inner casing 4 may be degraded when an external impact is applied to the refrigerator.

SUMMARY OF THE INVENTION

The present invention has been made in view of the above mentioned problems involved with the related art, and an object of the invention is to provide a direct cooling type refrigerator capable of rapidly and accurately controlling the temperature thereof.

Another object of the invention is to provide a direct cooling type refrigerator capable of reducing the ON/OFF time of its compressor, thereby preventing the temperature deviation of its storage compartment from increasing over a predetermined value.

Another object of the invention is to provide a temperature sensor fixing method in a refrigerator which is capable of firmly fixing a temperature sensor to an inner casing of the refrigerator.

In accordance with one aspect, the present invention provides a direct cooling type refrigerator comprising: an outer casing defining an appearance of the refrigerator; an inner casing arranged within the outer casing, and defined with a storage compartment; an insulator interposed between the outer casing and the inner casing; a compressor for compressing a refrigerant; an evaporator arranged to be in contact with the inner casing, and adapted to cool the inner casing in accordance with evaporation of a refrigerant passing therethrough; a temperature sensor provided with a surface contact area closely contacting the inner casing, and adapted to sense a temperature of the inner casing; and a control unit for controlling the compressor in accordance with the temperature sensed by the temperature sensor.

In accordance with another aspect, the present invention provides a temperature sensor fixing method in a refrigerator comprising the steps of: (A) forming, at a temperature sensor, a surface contact area adapted to come into contact with an inner casing of the refrigerator; (B) applying an adhesive to the surface contact area of the temperature sensor; and (C) bring the temperature sensor into close contact with the inner casing such that it is bonded to the inner casing at the surface contact area.

In accordance with another aspect, the present invention provides a temperature sensor fixing method in a refrigerator comprising the steps of: (A) forming, at a temperature sensor, a surface contact area adapted to come into contact with an inner casing of the refrigerator; (B) attaching a release tape coated with an adhesive to the surface contact area of the temperature sensor; and (C) separating the release tape from the temperature sensor such that the adhesive is exposed, and bring the temperature sensor into close contact with the inner casing such that it is bonded to the inner casing at the surface contact area.

BRIEF DESCRIPTION OF THE DRAWINGS

The above objects, and other features and advantages of the present invention will become more apparent after reading the following detailed description when taken in conjunction with the drawings, in which.

DESCRIPTION OF THE PREFERRED EMBODIMENTS

Now, preferred embodiments of the present invention will be described in detail with reference to the annexed drawings.

Figure 1:
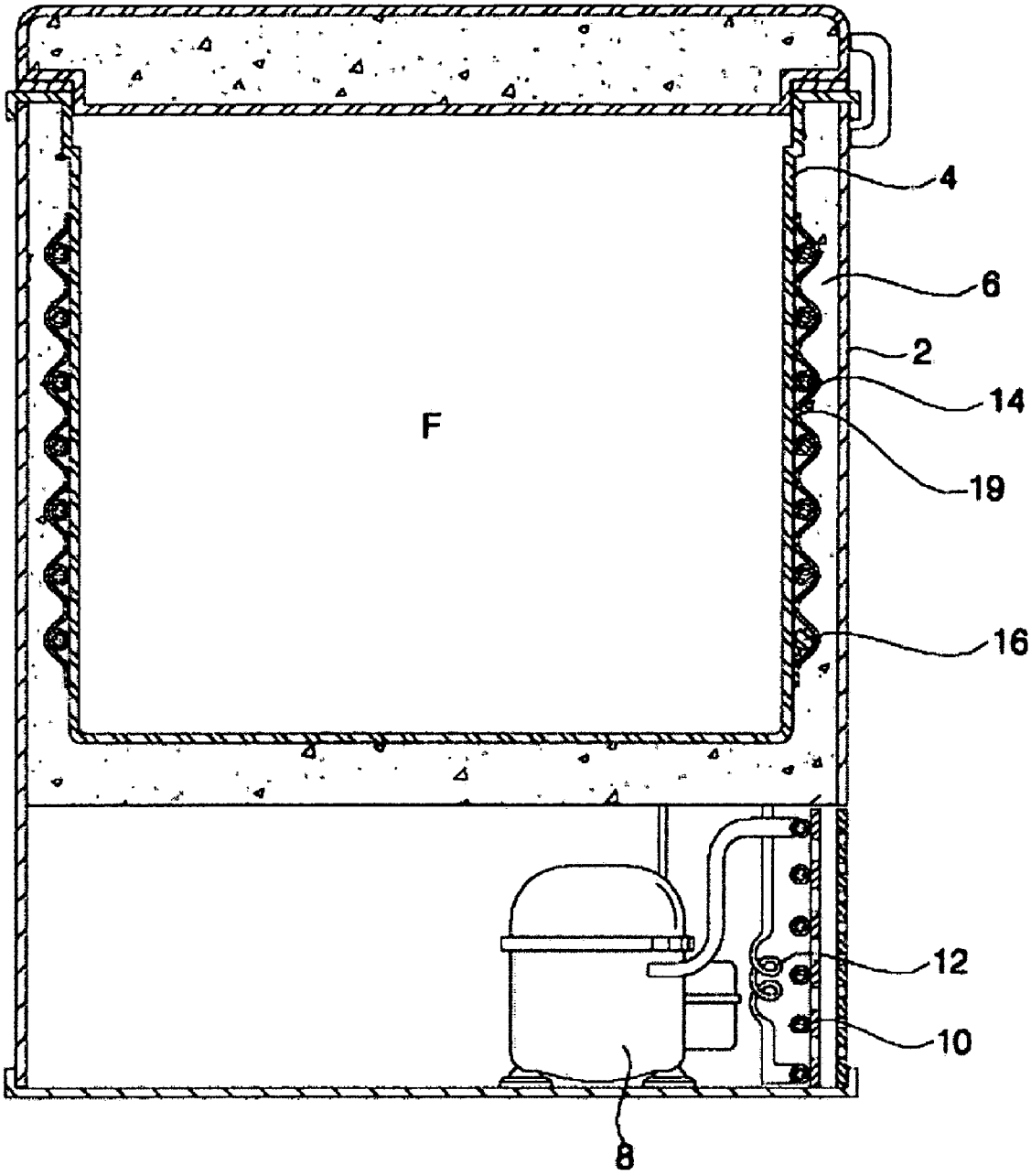
FIG. 1 (Prior Art)
FIG. 1 is a sectional view illustrating a general direct cooling type refrigerator.
Figure 2:
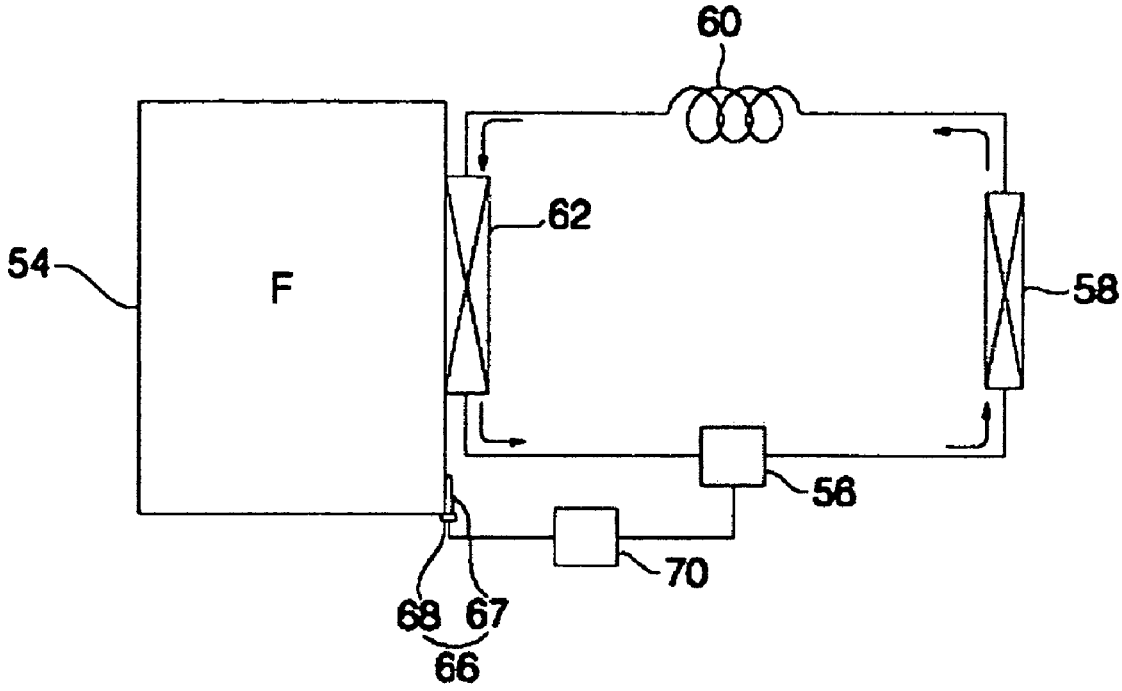
FIG. 2 is a block diagram illustrating the refrigerant circulation cycle in a direct cooling type refrigerator according to a first embodiment of the present invention.
Figure 3:
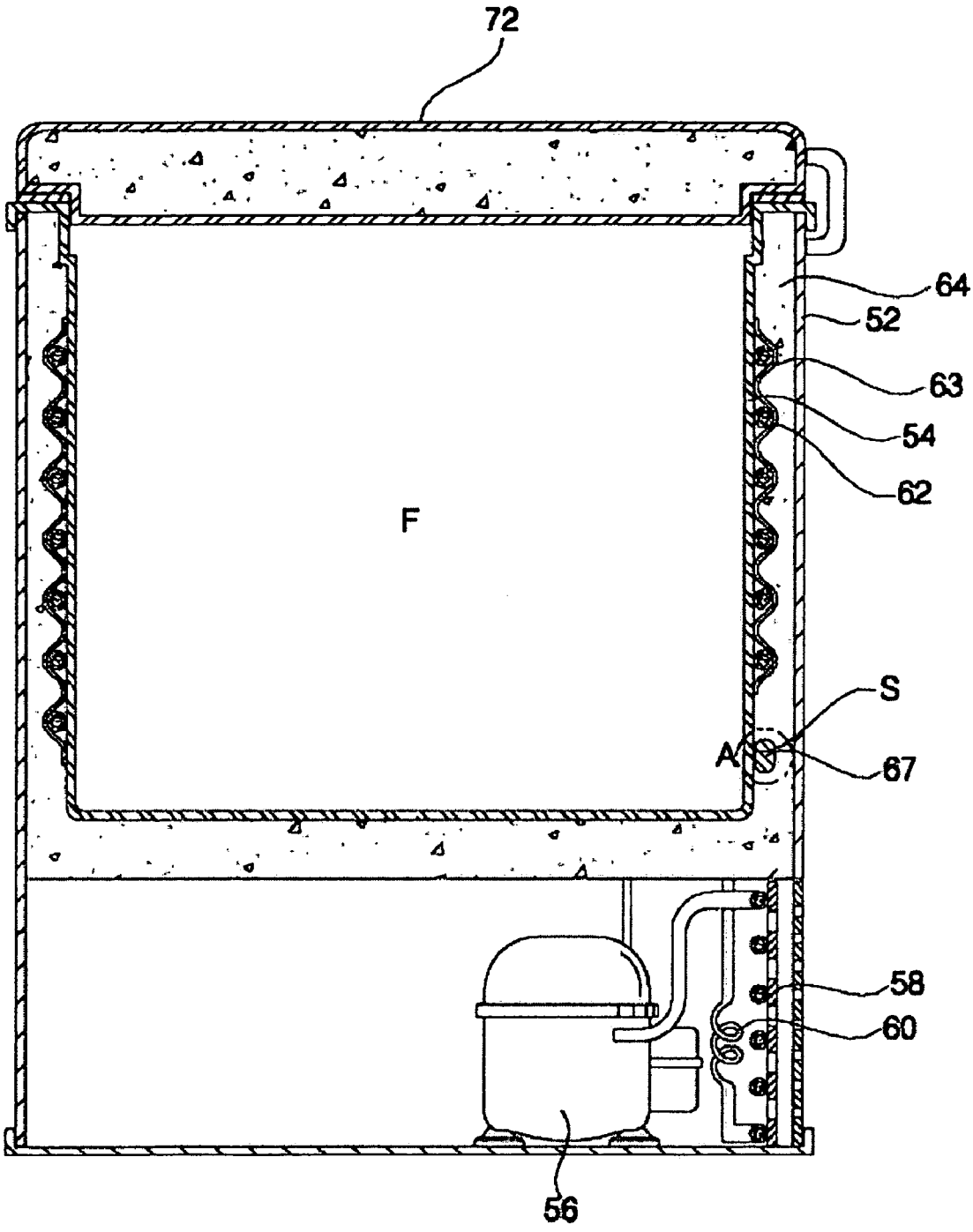
FIG. 3 is a sectional view illustrating an inner structure of the direct cooling type refrigerator according to the first embodiment of the present invention.
Figure 4:
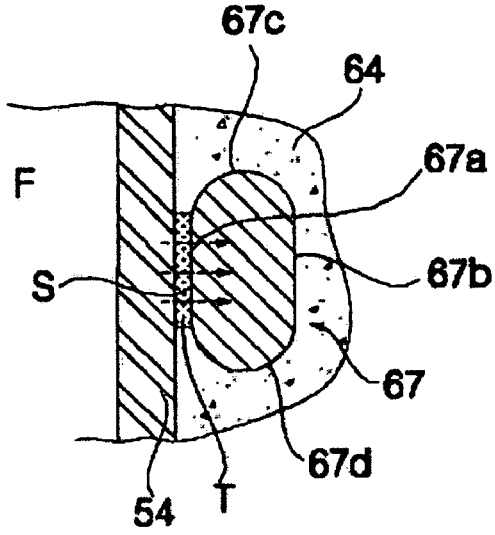
FIG. 4 is an enlarged view corresponding to a portion "A" in FIG. 3.

FIG. 2 is a block diagram illustrating the refrigerant circulation cycle in a direct cooling type refrigerator according to a first embodiment of the present invention. FIG. 3 is a sectional view illustrating an inner structure of the direct cooling type refrigerator according to the first embodiment of the present invention. FIG. 4 is an enlarged view corresponding to a portion "A" in FIG. 3.

As shown in FIGS. 2 to 4, the direct cooling type refrigerator according to the illustrated embodiment of the present invention includes an outer casing 52 defining the appearance of the refrigerator, and an inner casing 54 arranged within the outer casing 52, and defined with a storage compartment F. This direct cooling type refrigerator also includes a compressor 56 for compressing a refrigerant, a condenser 58 for condensing a high-pressure refrigerant gas emerging from the compressor 56 into a liquid phase, a capillary tube 60 for reducing the pressure of the refrigerant emerging from the condenser 58, an evaporator 62 for performing heat exchange with the inner casing 54, thereby cooling the inner casing 54, an insulator 64 interposed between the outer casing 52 and the inner casing 54, a temperature sensor 66 provided with a surface contact area S closely contacting the inner casing 54, and adapted to sense the temperature of the inner casing 54, and a control unit 70 for controlling the compressor 56 in accordance with the temperature sensed by the temperature sensor 66.

The evaporator 62 is attached to the outer side surfaces of the inner casing 54 while being covered by the insulator 64.

The evaporator 62 is an evaporating pipe arranged along the outer surface of the inner casing 54. This evaporating pipe has a plurality of connected pipe portions extending horizontally while being vertically spaced apart from one another. The evaporating pipe is fixed by aluminum tapes 63 attached to the inner casing 54.

The temperature sensor 66 includes a heat transfer member 67 attached to the inner casing 54, and provided with a surface contact area S at at least one surface thereof, and a thermistor 68 arranged to be in contact with a desired portion of the heat transfer member 67, and adapted to output a signal representing the temperature of the heat transfer member 67 to the control unit 70.

As shown in FIG. 4, the heat transfer member 67 is attached to one outer side surface of the inner casing 54 while being covered by the insulator 64. The surface contact area S extends in a longitudinal direction of the heat transfer member 67.

The heat transfer member 67 is made of a soft synthetic resin or metal.

The heat transfer member 67 has a bar structure having opposite flat side surfaces 67*a* and 67*b*, and curved upper and lower surfaces 67*c* and 67*d*. One of the opposite side surfaces 67*a* and 67*b* provides the surface contact area S to be in surface contact with the inner casing 54, so that heat from the inner casing 54 is transferred to the heat transfer member 67 via the surface contact area S, as indicated by arrows in FIG. 4.

The attachment of the heat transfer member 67 to the inner casing 54 is achieved by an adhesive T applied to the surface contact area S.

The control unit 70 serves to turn on the compressor 56 when the temperature sensed by the temperature sensor 66 is not less than a first predetermined temperature, for example, 5° C., while turning off the compressor 56 when the sensed temperature is not more than a second predetermined temperature, for example, −30° C.

In FIG. 3, the reference numeral "72" designates a door for opening and closing the storage compartment F.

Figure 5:
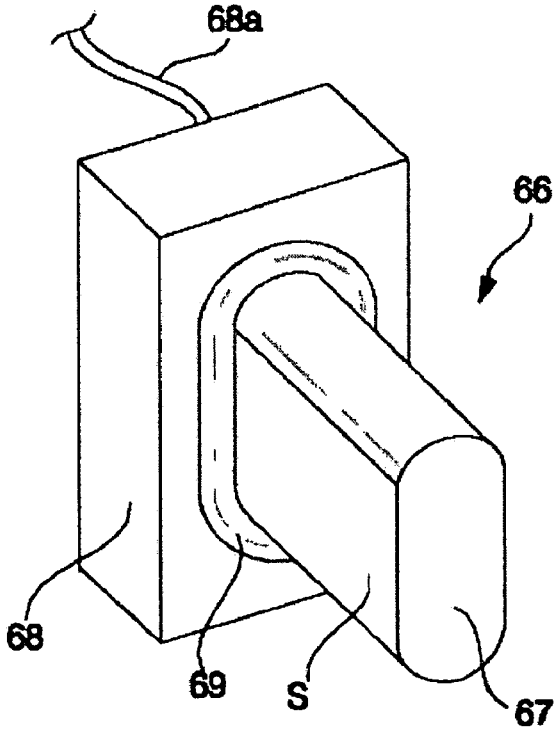
FIG. 5 is a perspective view illustrating a temperature sensor installed in the direct cooling type refrigerator in accordance with the present invention.

FIG. 5 is a perspective view illustrating the temperature sensor installed in the direct cooling type refrigerator in accordance with the present invention.

As shown in FIG. 5, the temperature sensor 66 further includes a coating 69 covering the contact area between the heat transfer member 67 and the thermistor 68.

In FIG. 5, the reference numeral "68*a*" designates an electric wire connected to the thermistor 68, and adapted to transmit a signal representing the temperature of the heat transfer member 67 to the control unit 70.

Now, operation of the refrigerator having the above described configuration according to the present invention will be described.

As shown in FIG. 4, heat from the inner casing 54 is rapidly transferred to the heat transfer member 67 via the surface contact area S where the heat transfer member 67 is in contact with the inner casing 54, as indicated by the arrows. The thermistor 68 measures the temperature of the heat transfer member 67, and sends a signal corresponding to the measured temperature to the control unit 70.

When the control unit 70 determines, based on the signal received thereto, that the temperature of the inner casing 54 is not less than the first predetermined temperature, for example, 5° C., it outputs an ON signal so as to operate the compressor 56.

In an ON state thereof, the compressor 56 compresses a refrigerant into a high-temperature and high-pressure vapor state. The compressed refrigerant is then introduced into the condenser 58. When the compressed refrigerant enters the condenser 58, it discharges heat therefrom around the condenser 58, so that it is condensed into a normal-temperature and high-pressure liquid phase. Subsequently, the refrigerant condensed by the condenser 58 is subjected to a pressure reduction process while passing through the capillary tube 60, and then absorbing heat from the inner casing 54 while passing through the evaporator 62, so that it is evaporated. The resultant refrigerant is then introduced into the compressor 58. In such a manner, the refrigerant circulates.

During the compression, condensation, expansion, and evaporation of the refrigerant carried out in the above described manner, the inner casing 54 discharges heat therefrom into the refrigerant passing through the evaporator 58, so that it is cooled. Accordingly, the interior of the storage compartment F is cooled by virtue of heat exchange performed between air present in the storage compartment F and the inner casing 54, and natural convection of the air in the storage compartment F.

As the inner casing 54 and storage compartment F are cooled in the above described manner, the heat from the inner casing 54 is rapidly transferred to the heat transfer member 67 via the surface contact area S contacting the heat transfer member 67, as indicated by the arrows in FIG. 4. Meanwhile, the thermistor 68 measures the temperature of the heat transfer member 67, and sends a signal representing the measured temperature to the control unit 70.

When the control unit 70 determines, based on the signal received thereto, that the temperature of the inner casing 54 is not more than the second predetermined temperature, for example, −30° C., it outputs an OFF signal to the compressor 58 so as to stop the operation of the compressor 58.

The interior of the storage compartment F is heated by heat penetrating into the storage compartment F through the insulator 64 and door 72 with the lapse of time, because the compressor 58 is maintained in its OFF state, and the low-temperature refrigerant is introduced into the compressor 56 no longer. Accordingly, the interior of the storage compartment F is not overcooled to a temperature not more than the second predetermined temperature, for example, −30° C.

Thereafter, the refrigerator repeats the turning on/off of the compressor 56 in accordance with the temperature sensed by the temperature sensor 66.

Figure 6:
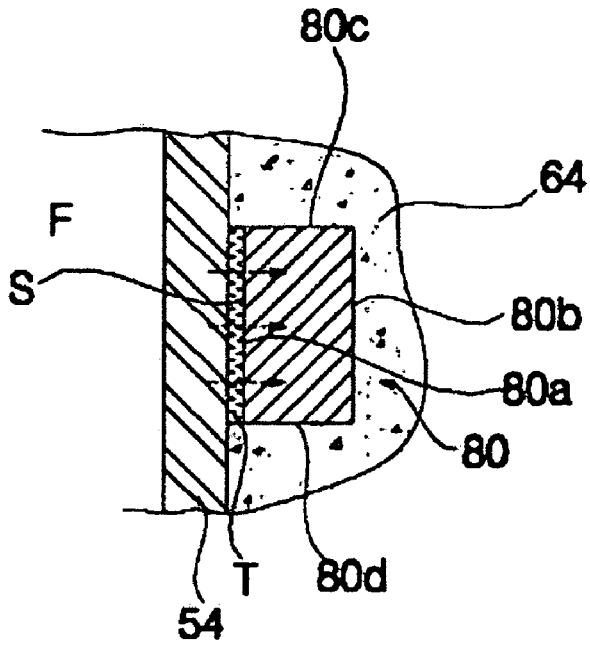
FIG. 6 is a sectional view illustrating an essential configuration of a direct cooling type refrigerator according to a second embodiment of the present invention.

Referring to FIG. 6, a temperature sensor according to a second embodiment of the present invention is illustrated.

The temperature sensor shown in FIG. 6 includes a heat transfer member 80 having a rectangular cross-sectional structure in which one of its four side surfaces 80*a* to 80*d*, that is, the side surface 80*a*, is in surface contact with the inner casing 54.

In this temperature sensor, the side surface 80*a* of the heat transfer member 80 provides the surface contact area S to be in surface contact with the inner casing 54. The remaining three side surfaces 80*b* to 80*d* are surrounded by the insulator 64.

Figure 7:
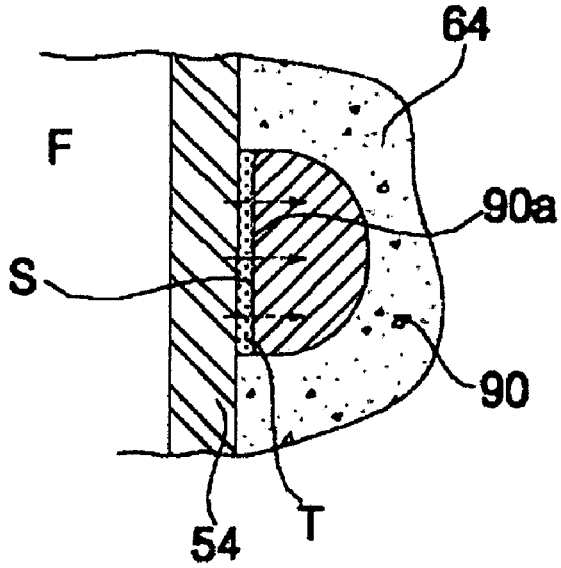
FIG. 7 is a sectional view illustrating an essential configuration of a direct cooling type refrigerator according to a third embodiment of the present invention.

Referring to FIG. 7, a temperature sensor according to a third embodiment of the present invention is illustrated.

The temperature sensor shown in FIG. 7 includes a heat transfer member 90 having a semicircular cross-sectional structure in which its flat side surface 90*a* is in surface contact with the inner casing 54.

In this temperature sensor, the side surface 90*a* of the heat transfer member 90 provides the surface contact area S to be in surface contact with the inner casing 54. The remaining surfaces of the heat transfer member 90 are surrounded by the insulator 64.

Figure 8:
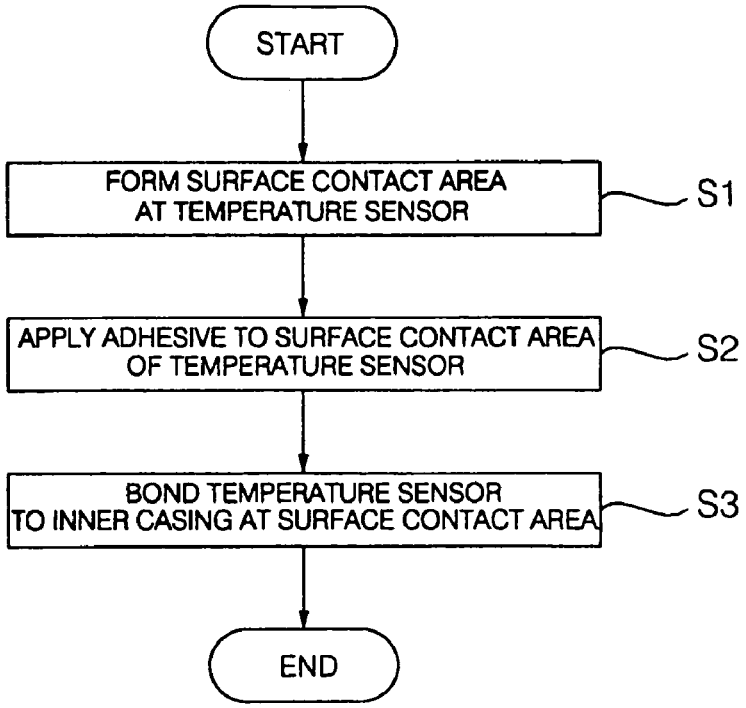
FIG. 8 is a flow chart illustrating a first embodiment of a temperature sensor fixing method in the direct cooling type refrigerator according to the present invention.
Figure 9:
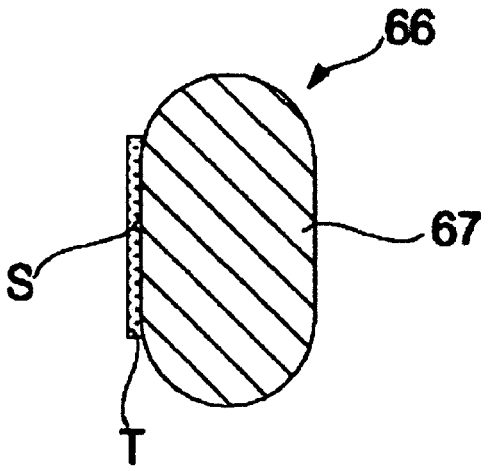
FIG. 9 is an enlarged sectional view illustrating the temperature sensor of the direct cooling type refrigerator according to the present invention which is not in a fixed state yet.

FIG. 8 illustrates a first embodiment of a temperature sensor fixing method in the direct cooling type refrigerator according to the present invention. FIG. 9 is an enlarged sectional view illustrating the temperature sensor of the direct cooling type refrigerator according to the present invention which is not in a fixed state yet.

In accordance with the temperature sensor fixing method, the surface contact area S adapted to come into contact with the inner casing 54 is first formed at the temperature sensor 66 (S1).

This first step includes a first procedure of forming the heat transfer member 67 such that it is flat at at least one side surface thereof, that is, the side surface 67*a*, and a second procedure of fixing the formed heat transfer member 67 to the thermistor 68.

The first procedure is achieved by injection-molding the heat transfer member 67 in a mold formed with a flat surface corresponding to the flat side surface 67*a*, by use of a melt synthetic resin, and then solidifying the molded heat transfer member 67. The second procedure is achieved by applying a liquid-phase coating material to the contact area between the heat transfer member 67 and the thermistor 68 to form the coating 69, and then solidifying the coating 69.

At a second step, the adhesive T is applied to the side surface 67*a* of the temperature sensor 66, that is, the surface contact area S (S2).

At a third step, the temperature sensor 66 is brought into close contact with the inner casing 54 so that it can be bonded to the inner casing 54 at the surface contact area S (S3).

Thus, the temperature sensor 66 is firmly fixed to the inner casing 54 in a state in which the surface contact area S is in surface contact with the inner casing 54.

Figure 10:
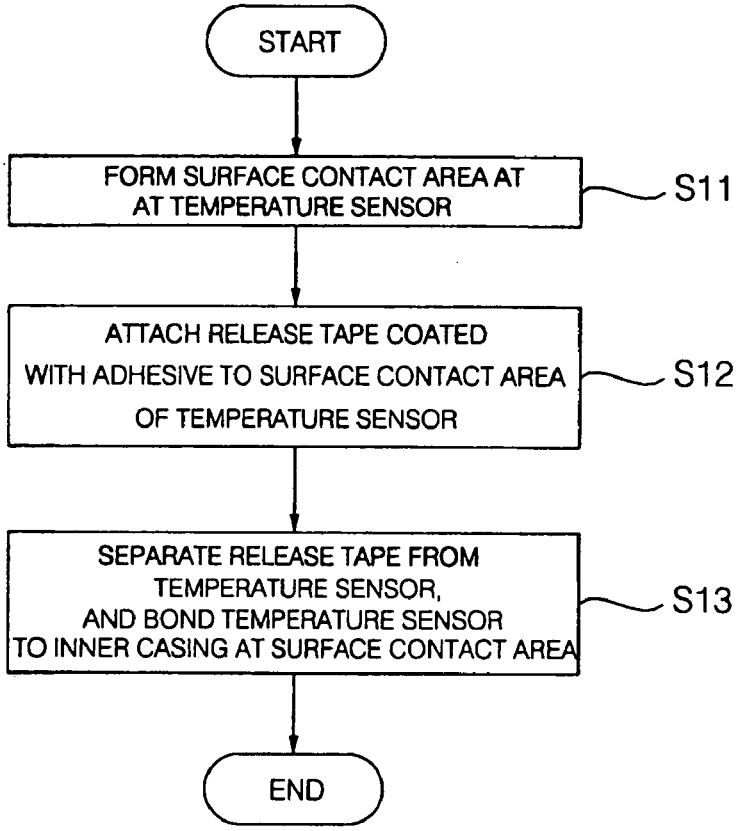
FIG. 10 is a flow chart illustrating a second embodiment of a temperature sensor fixing method in the direct cooling type refrigerator according to the present invention.
Figure 11:
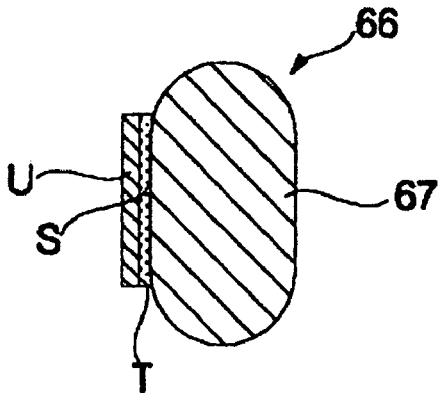
FIG. 11 is an enlarged sectional view illustrating the temperature sensor of the direct cooling type refrigerator according to the present invention which is not in a fixed state yet.

Referring to FIG. 10, a second embodiment of a temperature sensor fixing method in the direct cooling type refrigerator according to the present invention. FIG. 11 is an enlarged sectional view illustrating the temperature sensor of the direct cooling type refrigerator according to the present invention which is not in a fixed state yet.

In accordance with this temperature sensor fixing method, the surface contact area S adapted to come into contact with the inner casing 54 is first formed at the temperature sensor 66 (S11).

This first step is carried out in the same manner as in the first embodiment of the temperature sensor fixing method.

At a second step, a release tape U coated with the adhesive T is attached to the side surface 67*a* of the temperature sensor 66, that is, the surface contact area S (S12).

Preferably, the release tape U is made of a paper sheet or a synthetic resin film so that its attachment and detachment can be easily achieved.

Thus, the temperature sensor 66 can be stored or transported in a state of being attached with the adhesive T and release tape U.

At a third step, the release tape U is separated from the temperature sensor 66 such that the adhesive T is exposed. Thereafter, the temperature sensor 66 is brought into close contact with the inner casing 54 so that it can be bonded to the inner casing 54 at the surface contact area S (S13).

Thus, the temperature sensor 66 is firmly fixed to the inner casing 54 in a state in which the surface contact area S is in surface contact with the inner casing 54.

As apparent from the above description, the refrigerator having the above described configuration according to the present invention has an advantage in that it is possible to rapidly sense a temperature variation in the storage compartment and inner casing because the temperature sensor adapted to measure the temperature of the inner casing defined with the storage compartment is in surface contact with the inner casing, so that heat from the inner casing is transferred to the temperature sensor via a region where the temperature sensor is in surface contact with the inner casing.

Since the temperature sensor is in surface contact with the inner casing, it is also possible to minimize dispersion of the sensed temperature.

Since the temperature sensor can rapidly and accurately sense the temperature of the inner casing, it also provides an advantage of reducing the ON/OFF time of the compressor, thereby preventing the temperature deviation of the storage compartment from increasing over a predetermined value.

One temperature sensor fixing method in the above described direct cooling type refrigerator according to the present invention involves the steps of forming, at the temperature sensor, a surface contact area adapted to come into contact with the inner casing, applying an adhesive to the surface contact area of the temperature sensor, and bring the temperature sensor into close contact with the inner casing sensor such that it is bonded to the inner casing at the surface contact area. In accordance with this temperature sensor fixing method, it is possible to rapidly sense a variation in the temperature of the inner casing by the temperature sensor while minimizing dispersion of the sensed temperature. Also, there is an advantage in that the temperature sensor is firmly fixed to the inner casing.

Another temperature sensor fixing method in the above described direct cooling type refrigerator according to the present invention involves the steps of forming, at the temperature sensor, a surface contact area adapted to come into contact with the inner casing, and attaching a release tape coated with an adhesive to the surface contact area of the temperature sensor. Since the adhesive is protected by the release tape, it is possible to easily and conveniently store or transport the temperature sensor. When the temperature sensor is to be fixed, the release tape is separated from the temperature sensor such that the adhesive is exposed. In this state, the temperature sensor is brought into close contact with the inner casing such that it is bonded to the inner casing at the surface contact area. In accordance with this temperature sensor fixing method, it is possible to rapidly sense a variation in the temperature of the inner casing by the temperature sensor while minimizing dispersion of the sensed temperature. Also, there is an advantage in that the temperature sensor is firmly fixed to the inner casing.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A direct cooling type refrigerator comprising:

an outer casing;

an inner casing arranged within the outer casing, and defining a storage compartment;

an insulator interposed between the outer casing and the inner casing;

a compressor for compressing a refrigerant;

an evaporator in contact with the inner casing, and adapted to cool the inner casing in accordance with evaporation of the refrigerant passing therethrough;

a temperature sensor for sensing a temperature of the inner casing, the temperature sensor including:

a heat transfer member spaced apart from the evaporator, the heat transfer member having a substantially flat surface attached to the inner casing, and a thermistor in contact with the heat transfer member to sense the temperature of the inner case; and a control unit for controlling the compressor in accordance with the temperature sensed by the temperature sensor.

2. The direct cooling type refrigerator according to claim 1, wherein the thermistor is adapted to output a signal representing a temperature of the heat transfer member to the control unit.

3. The direct cooling type refrigerator according to claim 2, wherein the heat transfer member is arranged between the inner casing and the insulator.

4. The direct cooling type refrigerator according to claim 2, wherein the heat transfer member is made of a soft synthetic resin.

5. The direct cooling type refrigerator according to claim 2, wherein the heat transfer member is made of a metal.

6. The direct cooling type refrigerator according to claim 2, wherein the heat transfer member is attached to an outer surface of the inner casing.

7. The direct cooling type refrigerator according to claim 2, wherein the substantially flat surface extends in a longitudinal direction of the heat transfer member.

8. The direct cooling type refrigerator according to claim 2, wherein the heat transfer member has a bar structure having opposite flat side surfaces, and curved upper and lower surfaces.

9. The direct cooling type refrigerator according to claim 2, wherein the heat transfer member has a rectangular cross-sectional structure.

10. The direct cooling type refrigerator according to claim 2, wherein the heat transfer member has a semicircular cross-sectional structure.

11. The direct cooling type refrigerator according to claim 2, wherein the heat transfer member is coated with an adhesive at the substantially flat surface.

12. The direct cooling type refrigerator according to claim 2, wherein the temperature sensor further includes a coating surrounding a contact area between the heat transfer member and the thermistor.

13. A direct cooling type refrigerator comprising:

an outer casing defining an appearance of the refrigerator;

an inner casing arranged within the outer casing, and defined with a storage compartment;

an insulator interposed between the outer casing and the inner casing;

a compressor for compressing a refrigerant;

an evaporator arranged to be in contact with the inner casing, and adapted to cool the inner casing in accordance with evaporation of the refrigerant passing therethrough;

a temperature sensor provided with a surface contact area closely contacting the inner casing, and adapted to sense a temperature of the inner casing, wherein the temperature sensor includes a heat transfer member attached to the inner casing, and provided with a surface contact area at at least one surface thereof, and a thermistor arranged to be in contact with a portion of the heat transfer member, and adapted to output a signal representing a temperature of the heat transfer member to the control unit, wherein the heat transfer member is made of a soft synthetic resin; and a control unit for controlling the compressor in accordance with the temperature sensed by the temperature sensor.

14. A direct cooling type refrigerator comprising:

an outer casing defining an appearance of the refrigerator;

an inner casing arranged within the outer casing, and defined with a storage compartment;

an insulator interposed between the outer casing and the inner casing;

a compressor for compressing a refrigerant;

an evaporator arranged to be in contact with the inner casing, and adapted to cool the inner casing in accordance with evaporation of the refrigerant passing therethrough;

a temperature sensor provided with a surface contact area closely contacting the inner casing, and adapted to sense a temperature of the inner casing, wherein the temperature sensor includes a heat transfer member attached to the inner casing, and provided with a surface contact area at at least one surface thereof, and a thermistor arranged to be in contact with a portion of the heat transfer member, and adapted to output a signal representing a temperature of the heat transfer member to the control unit, wherein the heat transfer member has a bar structure having opposite flat side surfaces, and curved upper and lower surfaces; and a control unit for controlling the compressor in accordance with the temperature sensed by the temperature sensor.

15. A direct cooling type refrigerator comprising:

an outer casing defining an appearance of the refrigerator;

an inner casing arranged within the outer casing, and defined with a storage compartment;

an insulator interposed between the outer casing and the inner casing;

a compressor for compressing a refrigerant;

an evaporator arranged to be in contact with the inner casing, and adapted to cool the inner casing in accordance with evaporation of the refrigerant passing therethrough;

a temperature sensor provided with a surface contact area closely contacting the inner casing, and adapted to sense a temperature of the inner casing, wherein the temperature sensor includes a heat transfer member attached to the inner casing, and provided with a surface contact area at at least one surface thereof, and a thermistor arranged to be in contact with a portion of the heat transfer member, and adapted to output a signal representing a temperature of the heat transfer member to the control unit, wherein the heat transfer member has a semicircular cross-sectional structure; and a control unit for controlling the compressor in accordance with the temperature sensed by the temperature sensor.

16. A direct cooling type refrigerator comprising:

an outer casing defining an appearance of the refrigerator;

an inner casing arranged within the outer casing, and defined with a storage compartment;

an insulator interposed between the outer casing and the inner casing;

a compressor for compressing a refrigerant;

an evaporator arranged to be in contact with the inner casing, and adapted to cool the inner casing in accordance with evaporation of the refrigerant passing therethrough;

a temperature sensor adapted to sense a temperature of the inner casing, wherein the temperature sensor includes a heat transfer member attached to the inner casing, said heat transfer member having a substantially flat surface at at least one surface thereof, and a thermistor arranged to be in contact with a portion of the heat transfer member, to sense the temperature of the inner case, wherein the heat transfer member is attached directly to the inner casing by an adhesive which is coated on the substantially flat surface of the heat transfer member; and a control unit for controlling the compressor in accordance with the temperature sensed by the temperature sensor.

* * * * *